US008850707B2

(12) United States Patent
Maichel et al.

(10) Patent No.: US 8,850,707 B2
(45) Date of Patent: Oct. 7, 2014

(54) HAIR TRIMMER

(75) Inventors: Michael Maichel, Frankfurt (DE); Peter Schaefer, Waldbrunn-Lahr (DE); Juergen Behrendt, Niederbrechen (DE)

(73) Assignee: Braun GmbH, Kronberg (DE)

( * ) Notice: Subject to any disclaimer, the term of this patent is extended or adjusted under 35 U.S.C. 154(b) by 440 days.

(21) Appl. No.: 12/679,017

(22) PCT Filed: Oct. 9, 2008

(86) PCT No.: PCT/EP2008/008518

§ 371 (c)(1),
(2), (4) Date: Oct. 13, 2010

(87) PCT Pub. No.: WO2009/052952

PCT Pub. Date: Apr. 30, 2009

(65) Prior Publication Data

US 2011/0016723 A1 Jan. 27, 2011

(30) Foreign Application Priority Data

Oct. 22, 2007 (DE) ..... 10 2007 050 379

(51) Int. Cl.

| | |
|---|---|
| ***B26B 19/00*** | (2006.01) |
| ***B26B 19/02*** | (2006.01) |
| ***B26B 19/12*** | (2006.01) |
| ***B26B 19/38*** | (2006.01) |
| ***B26B 21/40*** | (2006.01) |
| ***B26B 19/20*** | (2006.01) |
| ***B26B 19/06*** | (2006.01) |

(52) U.S. Cl.

CPC ..... *B26B 19/06* (2013.01); *B26B 19/3846* (2013.01); *B26B 21/40* (2013.01); *B26B 19/20* (2013.01); *B26B 19/382* (2013.01)

USPC ..... 30/34.1; 30/200; 30/208; 30/34.2

(58) Field of Classification Search

USPC ..... 30/34.1, 34.2, 82, 233.5, 200, 208, 209, 30/210

See application file for complete search history.

(56) References Cited

U.S. PATENT DOCUMENTS 3,969,819 A * 7/1976 Pepera ..... 30/200
4,322,885 A 4/1982 Osada (Continued)

FOREIGN PATENT DOCUMENTS

CA 2212561 2/1998
JP 50-30994 U 7/1973

(Continued)

OTHER PUBLICATIONS

U.S. Appl. No. 12/522,285, filed Jul. 7, 2009, Uwe Fischer et al.

(Continued)

*Primary Examiner* — Omar Flores Sanchez
(74) *Attorney, Agent, or Firm* — Jay A. Krebs; Brent M. Peebles

(57) ABSTRACT

A hair trimmer is disclosed, comprising a fixed cutting element having teeth on the front side thereof, and a mobile cutting element which has teeth on the front side thereof and is oscillable in relation to the fixed cutting element, so that, when the hair trimmer is used, hairs reaching between the teeth of the fixed cutting element and the mobile cutting element are cut off. The hair trimmer also has a protective support which has teeth on its front side, is arranged on the fixed cutting element, and used to place the hair trimmer on the skin of the user. The teeth of the protective support lock with the teeth of the fixed cutting element on the front side or slightly extend over the teeth, and the teeth of the protective support lie on the fixed cutting element, essentially without gaps.

19 Claims, 4 Drawing Sheets

(56) References Cited

U.S. PATENT DOCUMENTS

Figure 1:
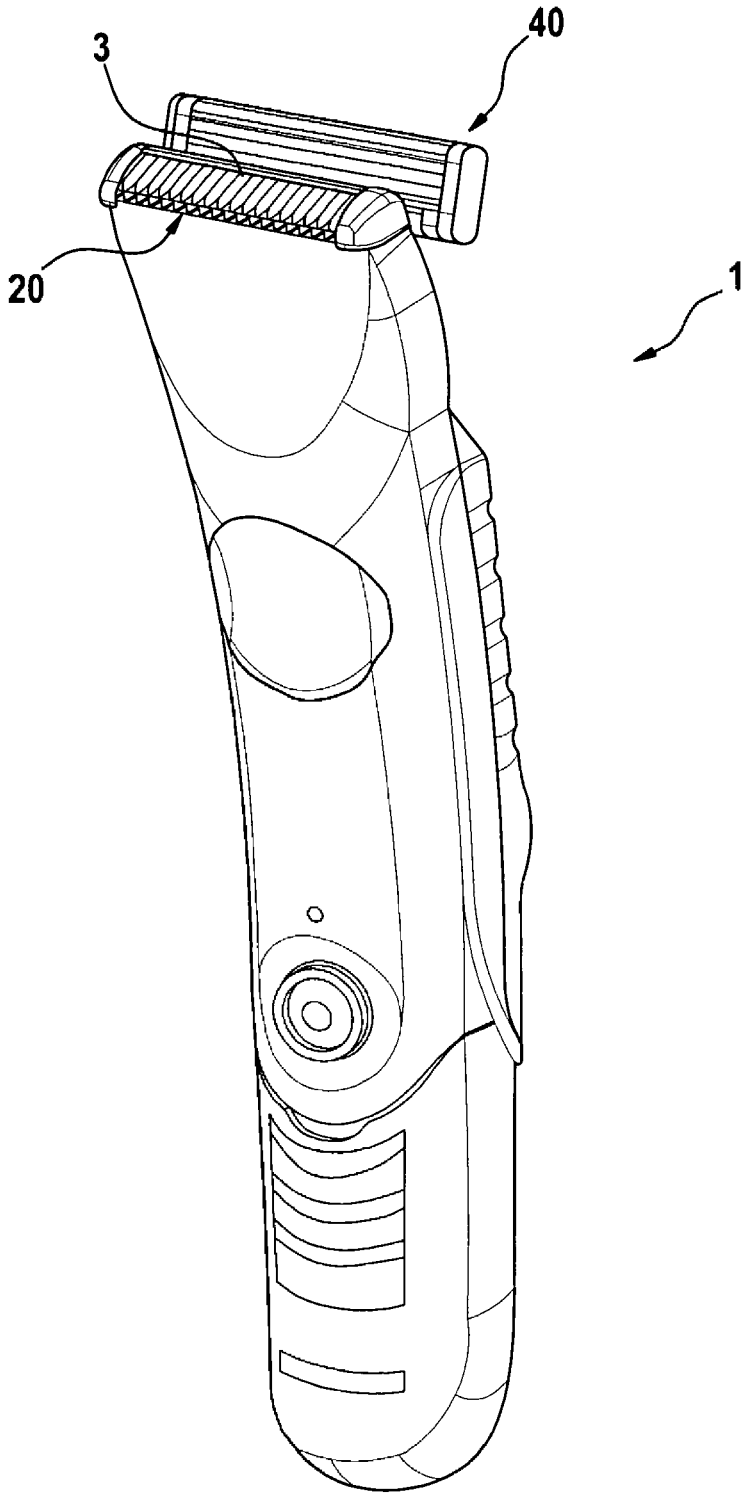

| | | | | |
|---|---|---|---|---|
| 4,393,585 | A | 7/1983 | Nagelkerke | |
| 4,510,687 | A * | 4/1985 | Groothuis et al. | 30/34.2 |
| 4,558,517 | A | 12/1985 | Gringer | |
| 4,724,614 | A * | 2/1988 | Wahl et al. | 30/200 |
| 4,825,546 | A | 5/1989 | Araki et al. | |
| 5,497,553 | A | 3/1996 | Chong | |
| 5,502,896 | A | 4/1996 | Chen | |
| 6,052,905 | A | 4/2000 | Branchinelli et al. | |
| 6,101,721 | A | 8/2000 | Medhurst | |
| 6,192,586 | B1 | 2/2001 | Metcalf et al. | |
| 6,226,869 | B1 | 5/2001 | Heintke et al. | |
| 6,584,696 | B2 | 7/2003 | Ferraro | |
| 6,739,054 | B2 | 5/2004 | Oswald | |
| 7,100,286 | B2 * | 9/2006 | Nakakura et al. | 30/201 |
| 7,288,863 | B2 | 10/2007 | Kraus | |
| D568,534 | S | 5/2008 | Micinilio et al. | |
| D571,954 | S | 6/2008 | Kling et al. | |
| 7,434,317 | B2 | 10/2008 | Levine et al. | |
| 7,533,467 | B2 | 5/2009 | Fossella | |
| 7,536,787 | B2 | 5/2009 | Blaustein et al. | |
| 2002/0108252 | A1 | 8/2002 | Ferraro | |
| 2005/0217115 | A1 | 10/2005 | Balustein et al. | |
| 2007/0006463 | A1 | 1/2007 | Pennella | |
| 2007/0180699 | A1 | 8/2007 | Psimadas et al. | |
| 2008/0016691 | A1 | 1/2008 | Pennella et al. | |
| 2008/0086887 | A1 | 4/2008 | Park et al. | |
| 2008/0184565 | A1 * | 8/2008 | Zoot et al. | 30/196 |
| 2009/0187523 | A1 | 7/2009 | Salvatore | |
| 2010/0011585 | A1 | 1/2010 | Maichel et al. | |
| 2010/0139097 | A1 | 6/2010 | Perez-Lopez et al. | |
| 2010/0299927 | A1 | 12/2010 | Fischer et al. | |
| 2011/0016723 | A1 | 1/2011 | Maichel et al. | |
| 2011/0126412 | A1 | 6/2011 | Perez-Lopez et al. | |

FOREIGN PATENT DOCUMENTS

| | | | |
|---|---|---|---|
| JP | 54-16690 | U | 7/1977 |
| JP | 55-091670 | U | 6/1980 |
| JP | 56-100089 | A2 | 8/1981 |
| JP | 04-003667 | U | 1/1992 |
| JP | 2003-71155 | A | 3/2003 |
| WO | WO 95-10398 | | 4/1995 |

OTHER PUBLICATIONS

U.S. Appl. No. 12/679,909, filed Sep. 27, 2008, Uwe Fischer et al.

* cited by examiner

HAIR TRIMMER

The invention relates to a hair trimmer comprising a fixed cutting element having teeth on the front side thereof, and a mobile cutting element that has teeth on the front side thereof and is oscillable in relation to the fixed cutting element so that when the hair trimmer is used, hairs that get caught between the teeth of the fixed cutting element and the mobile cutting element are cut off.

Hair trimmers of the type indicated are known. They are used, for example, in professional salons by hair stylists or by private users to trim scalp or beard hair.

Another area of application is body grooming, in which the user primarily wishes to achieve an esthetic effect by thoroughly removing hair in other areas of the body, for example in the armpit area, the bikini zone or in intimate areas. A disadvantage of known trimmers is that either the distance between the teeth of the cutting element is so great that the thin skin in the named areas of the body can bet caught between the teeth and then be painfully cut or, as in the case of the close-fitting teeth of the cutting element, the teeth themselves have to be so narrow that they can get caught in the relatively broad capillary ducts of the skin in the named areas of the body and when the hair trimmer moves, it can cause painful cuts in them.

A shaving device is known from patent specification DE 19633824C1 that has a hair trimmer of the type named at the beginning which is designed to cut long hair. To protect against skin irritations, the long-hair cutter has a skin-protection element that is arranged on the front side of the cutting elements that can move against one another and which protects the skin against direct contact with the cutting teeth of the cutting element. However, the disadvantage of this skin-protection element is that when shaving in the named areas of the body, the skin comes in contact with the metallic fixed cutting element and the user may experience this cold contact as unpleasant. In addition, when the hair trimmer moves back and forth on the skin, the movable fingers of the skin-protection element can cause a fold of the skin to get pinched between the skin-protection element and the cutting element. As a result, the skin can get caught between the teeth of the fixed cutting element and consequently cut.

The object of the present invention is to design an improved hair trimmer that provides a high degree of comfort during use and prevents painful skin injuries while at the same time is able to thoroughly cut hair near the surface of the skin.

The object is achieved by a hair trimmer according to the features of claim 1. The dependent claims describe further embodiments.

The hair trimmer according to claim 1 has a protective support that is arranged on the fixed cutting element and serves to place the hair trimmer on the skin of the user during use. With a suitable choice of material and/or preparation the surface, the user can achieve a pleasant feeling in that, for example, a plastic is chosen as the material for the protective support so that it doesn't feel cold upon contact with the skin. Because the protective support has teeth in the front area, these teeth of the protective support can reach up to the front area of the fixed cutting element without needing to cover the teeth of the fixed cutting element. Because the teeth of the protective support lock with the teeth of the fixed cutting element on its front side or slightly extend over said teeth, the skin of the user does not come into contact with the teeth of the fixed cutting element during typical use or only comes into contact with the front side of the teeth. At the same time, this also ensures that the teeth of the protective support cannot get caught in the capillary ducts with the teeth of the fixed cutting elements because the teeth of the protective support that mesh on the front side or that slightly extend over said teeth prevent this by their additional support surfaces on the front side. Thus, the front-side, protective surfaces of the teeth of the protective support must be chosen so that it is essentially impossible for them to become caught in capillary ducts.

Although the teeth of the protective support can extend slightly beyond the teeth of the fixed cutting element, this extension is preferably only provided in the extension section of the teeth of the fixed cutting element, so that the teeth of the protective support consequently do not extend to the front side of the teeth of the fixed cutting element. This makes it possible to bring the front side of the teeth of the fixed cutting element very close to the surface of the skin, which likewise allows the hair to be cut or sheared off very close to the surface of the skin. Known protective supports do not allow this to occur. In this instance, "slightly" means that the teeth of the protective support do not extend over the teeth of the fixed cutting element more than the length corresponding to the front-side thickness of the teeth of the fixed cutting element.

In one embodiment of the hair trimmer, the middle distance of the teeth of the protective support is greater than the middle distance of the teeth of the fixed cutting element. In this connection, it is particularly beneficial when the middle distance of the teeth of the protective support is a whole number multiple of the middle distance of the teeth of the fixed cutting element. This creates a regular pattern of allocation between the teeth of the protective support and the teeth of the fixed cutting element.

In another embodiment of the hair trimmer, the teeth of the protective support are wider than the teeth of the fixed cutting element. The increased width of the teeth of the protective support helps prevent catching the teeth of the fixed cutting element in the capillary ducts.

In another embodiment, a tooth of the protective support overlaps at least one space between two teeth of the fixed cutting element. As a result, the teeth of the protective support can be designed to be especially broad compared to the teeth of the fixed cutting element, which helps in particular to prevent the teeth of the fixed cutting element from getting caught in capillary ducts. If exactly one space between the teeth of the fixed cutting element overlaps, the cutting efficiency of only one space will also be affected by the supported teeth of the protective support.

In a modification of the preceding embodiment, one tooth of the protective support has a protrusion that extends to the overlapped space between two teeth of the fixed cutting element. Because the protective support lies on the fixed cutting element essentially without gaps (in some embodiments the fixed cutting element is crimped with the protective support) and the teeth of the protective support lie spring loaded on the fixed cutting element, hair can get pinched between the teeth of the protective support and the teeth of the fixed cutting element during use of the hair trimmer and this hair can be painfully pulled out when the trimmer moves against the skin. The protrusion extending into the space effectively prevents hair from getting pinched between the teeth, in particular if the protrusion locks with the teeth of the fixed cutting element or slightly extends beyond the front of the teeth of the fixed cutting element.

In another embodiment, the teeth of the protective support are rounded off on the front side, which helps create a pleasant feel on the skin during use of the hair trimmer.

In another embodiment, the height of the teeth of the protective support diminishes toward the front side of the hair trimmer, which helps to thoroughly remove hair because, as a result, the cutting elements can be brought very close to the skin and hair can be cut off very close to the skin.

In another embodiment, the protective support is connected without gaps, at least in the area of the teeth, to the fixed cutting element, for example by adhesion. A gap-free connection does not allow any hair to get caught between the teeth of the protective support and the teeth of the fixed cutting element.

In another embodiment of the hair trimmer, the middle distance between the teeth of the fixed cutting element is 0.1 to 0.9 mm, preferably 0.3 to 0.7 mm. In particular with a middle distance of approximately 0.5 mm±0.05 mm and a middle width of the teeth of the fixed cutting element of approximately 0.3 mm±0.03 mm, the teeth of the fixed cutting element still have sufficient stability but in addition, skin is prevented from get caught between the teeth of the fixed cutting element because skin folds are typically thicker than the space of approximately 0.2 mm that exists between the teeth of the fixed cutting element. In one embodiment, the fixed cutting element is made out of sheet metal with a thickness from 0.1 to 0.5 mm, preferably 0.25 to 0.35 mm. This gives the sheet sufficient stability and also helps remove the hair thoroughly because, as a result of the relatively low metal gauge, the cutting can consequently be carried out very close to the surface of the skin.

The invention is described below by means of exemplary embodiments in relation to several figures.

Figure 2:
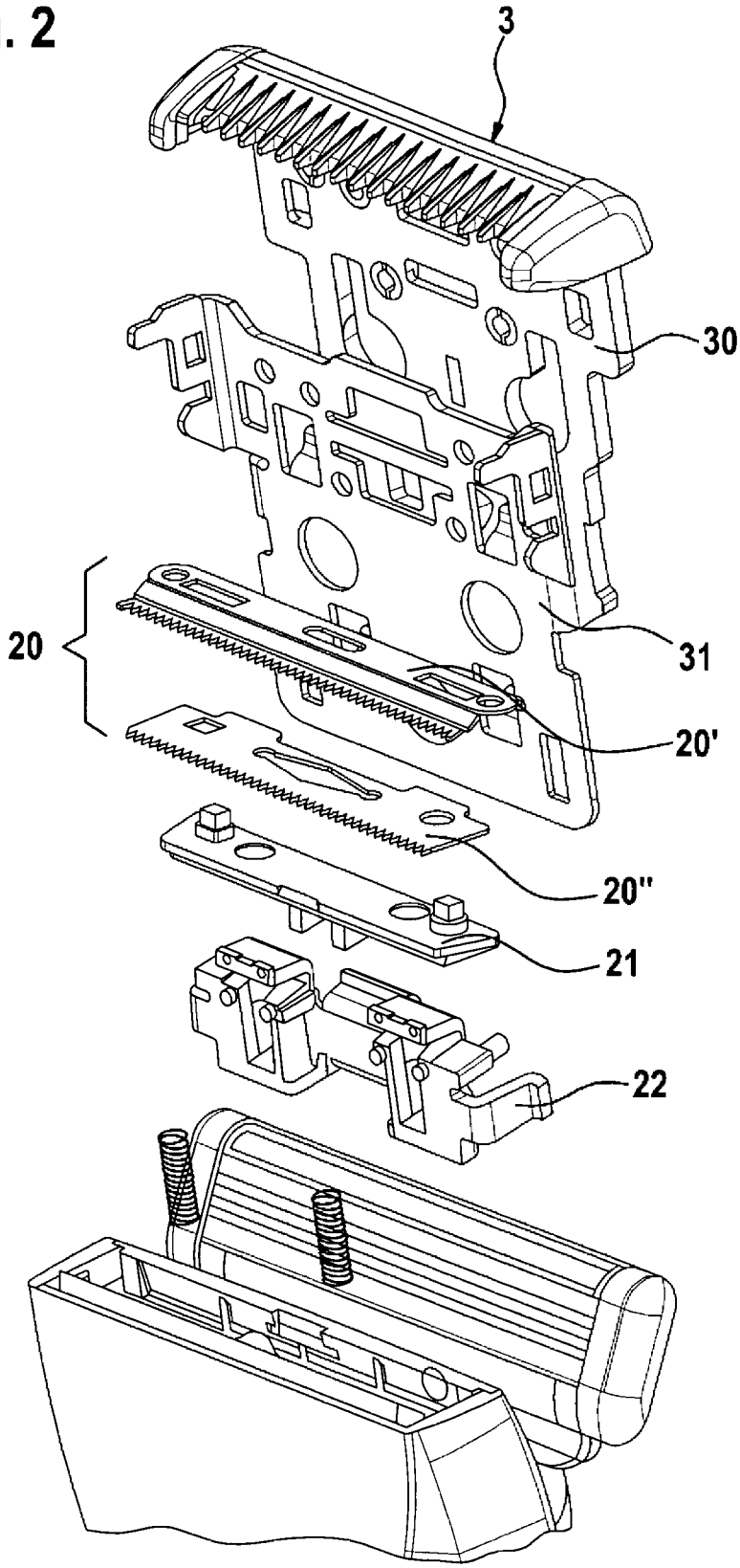
Figure 3:
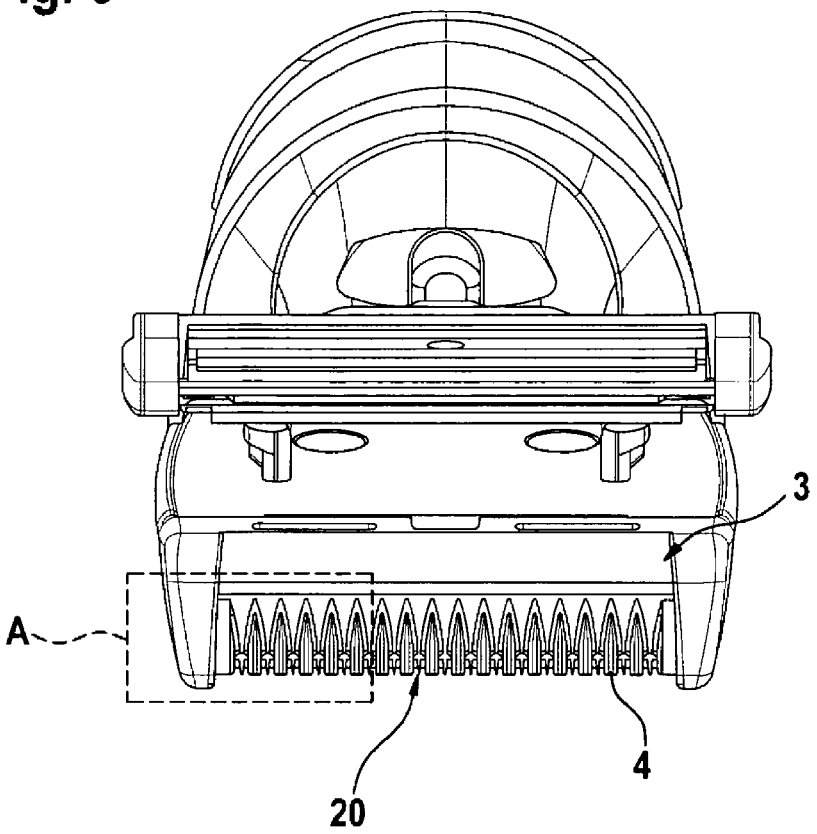
Figure 4:
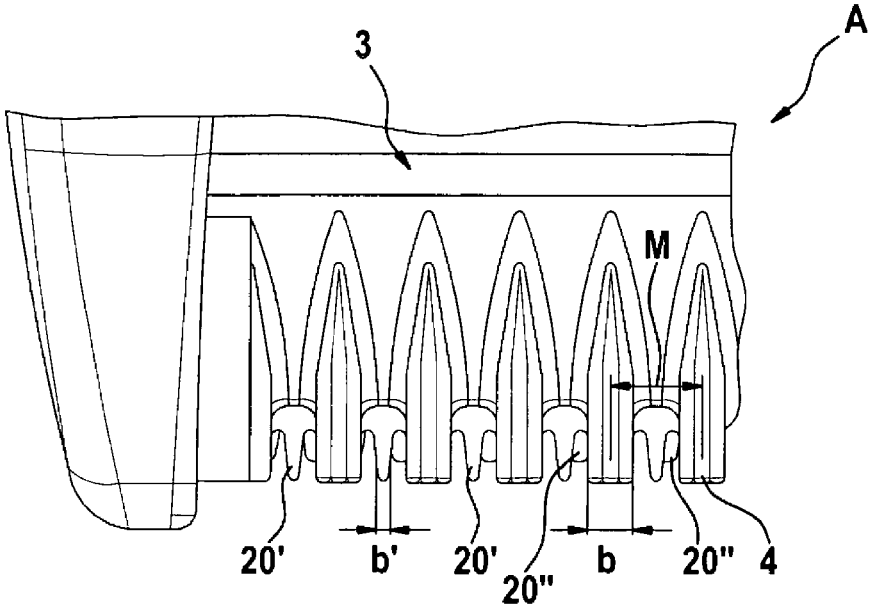
Figure 5:
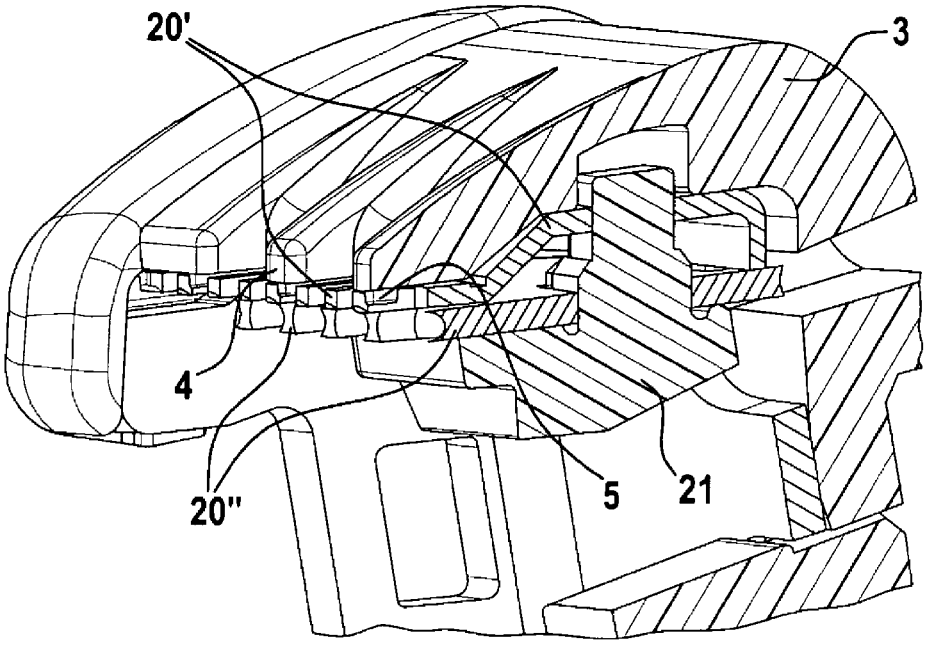
Figure 6:
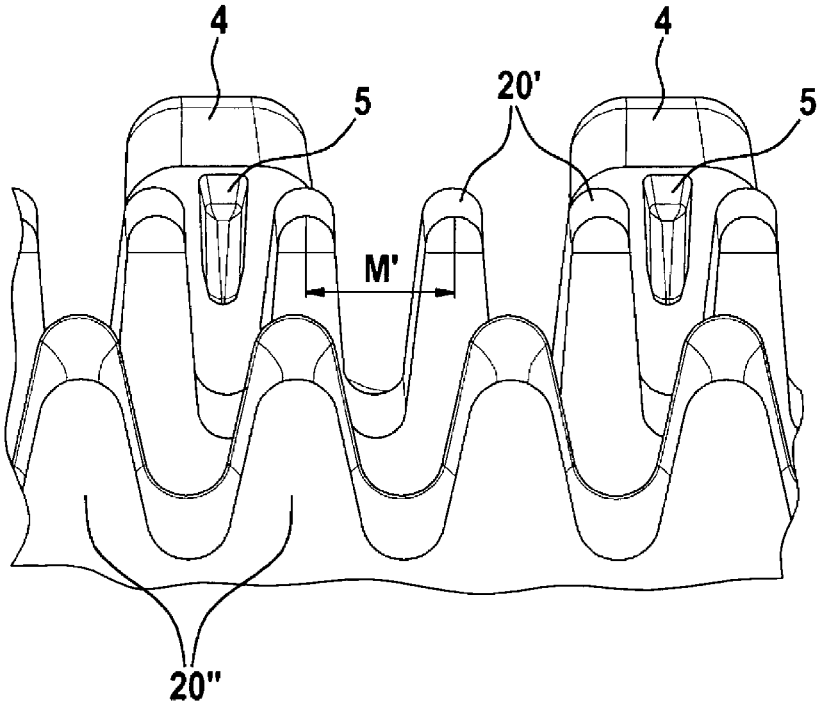

FIG. 1 shows a side front view of an exemplary example of an exemplary embodiment of a hair trimmer, FIG. 2 shows an exploded view of the head of the hair trimmer according to FIG. 1, FIG. 3 shows a top view of the head of the hair trimmer according to FIG. 1, FIG. 4 shows an enlarged, detailed section of the top view of the hair trimmer from FIG. 3, FIG. 5 shows a side view of a vertical head of a hair trimmer cut-off at right angles to the front side, FIG. 6 shows a detailed view of the teeth of the cutting element and the protective support in a visual angle slanting upward.

FIG. 1 shows an exemplary example of a hair trimmer 1. In the embodiment shown, a trimmer unit 20, which (as can be seen in FIG. 2) consists of a fixed cutting element and a mobile cutting element, is arranged on the head of the hair trimmer and a wet shaver having a blade cartridge 40 that can be pushed to the back of the hair trimmer so that in addition to (or at the same time as) removing hair electrically, hair can also be removed by a blade. A protective support 3 is arranged on the trimmer unit 20. In this embodiment, the protective support consists of a plastic material that creates a pleasant feel on the skin when the hair trimmer having the protective support is applied to the skin and pulled over the skin.

FIG. 2 is an exploded view of the head of the hair trimmer from FIG. 1 without an exploded view of the wet shaver. In this embodiment, the protective support 3 was manufactured in one piece with a plastic framework 30, for example by means of a plastic injection-mold method. To strengthen the overall structure, a metal framework 31 is connected to the plastic framework 30. The trimmer unit 20 consists of a fixed cutting element 20' (comb) and a mobile cutting element 20" (blade) that can oscillate in a linear fashion in relation to the fixed cutting element 20'. In this instance, the fixed cutting element 20' is crimped on the head side having the protective support. The fixed cutting element 20' has teeth arranged on the front side that interact with the teeth of the mobile cutting element 20" that are also arranged on the front side in such a way that hair that gets caught between the teeth of the fixed cutting element 20' are removed by the oscillating movement of the mobile cutting element 20", wherein, depending on the design of the teeth of the mobile cutting element 20", the removal process consists of cutting or shearing. The mobile cutting element 20" sits on a carrier 21 that on the bottom side has a guide that engages a movement transformer (not shown) in order to oscillate the carrier 21 having the mobile cutting element 20" in a linear fashion parallel to the front side and in relation to the fixed cutting element 20'. By means of a pressure element 22 in which springs are arranged, the mobile cutting element 20" is pressed against the fixed cutting element 20'.

FIG. 3 is a top view of the head of the hair trimmer 1 according to FIG. 1. In this case, it is clear that the protective support 3 has teeth 4 in the front area. Teeth of the fixed cutting element 20' can be seen between the teeth 4 of the protective support 3. Dotted lines outline a section A, which FIG. 4 shows in an enlarged view.

FIG. 4 shows the enlarger, detailed section A from FIG. 3. Five teeth 4 of the protective support 3 can be seen. The teeth 4 of the protective support 3 extend on the front side slightly over the teeth of the fixed cutting element 20' (which is easier to see in FIG. 6). At the same time, the teeth 4 of the protective support only extend slightly into their area of extension, which is also the area of extension of the teeth of the fixed cutting element 20', in front of the teeth of the fixed cutting element 20'. The teeth 4 of the protective support 3 do not extend to the front side of the teeth of the fixed cutting element 20'. In this embodiment, the middle distance M between the teeth 4 of the protective support is three times as great as the middle distance M' (which is shown in FIG. 6) between the teeth of the fixed cutting element 20', and the width b of the teeth 4 of the protective support 3 is approximately two and a half times greater than the width b' of the teeth of the fixed cutting element 20'. Teeth of the mobile cutting element 20" can be seen. In this instance, the middle distance of the teeth 4 of the protective support 3 is 1.65 mm and the width b is 0.7 mm. However, these values should only be considered as examples. The width b' of the teeth of the fixed cutting element is approximately 0.3 mm.

FIG. 5 shows a side-front view of the vertical head of the hair trimmer with the trimmer unit cut at right angles to the front side. The fixed cutting element 20' is cascaded and bent upward behind the teeth that are arranged in the front area so that the friction between the fixed cutting element 20' and the mobile cutting element 20" is minimized. The teeth of the fixed cutting element 20' and the teeth of the mobile cutting element 20" lie parallel to one another and thus define the cutting section. The mobile cutting element 20" is pressed onto protrusions of the carrier 21. The protrusions also mesh with precision slots of the fixed cutting element 20' in order to guarantee a parallel guide during linear-oscillating movement of the mobile cutting element 20. It is clear that the height of the teeth 4 of the protective support 3 is reduced up to the front side and that the teeth 4 of the protective support 3 are rounded off in the front area. In this instance, the height of the teeth 4 of the protective support is approximately 0.5 mm. In addition, the teeth 4 of the protective support 3 lie essentially gap-free on the fixed cutting element 20'. Because the fixed cutting element 20' in the embodiment described is crimped in the highly bent area with the protective support 3, the teeth 4 of the protective support 3 lie only gently on the teeth of the fixed cutting element. Hair that is caught during use of the hair trimmer in the tiny gap between the teeth 4 of the protective support 3 and the teeth of the fixed cutting element 20' can pry open this tiny gap against the elastic force of the crimping in the rear of the protective support and become pinched between the teeth 4 of the protective support 3 and the teeth of the fixed cutting element 20' so that they can be painfully torn from the skin and also clog the trimmer unit so that no other hair can get caught. In order to prevent this, it can be provided that teeth 4 of the protective support 3 can be connected gap-free to the teeth of the fixed cutting element 20', for example by adhesion with a suitable adhesive. Another option is to provide the teeth with a suitable protrusion. This is described in the next section with reference to FIG. 6.

FIG. 6 shows a detailed image of the teeth of the mobile cutting element 20", the teeth of the fixed cutting element 20', and the teeth 4 of the protective support 3 in visual angle slanting upward. The teeth of the mobile cutting element 20" are, as is customary, set back from the front side. The teeth of the mobile cutting element 20" have, as is customary, another cutting element 20', which in this instance has a greater middle distance than the teeth of the fixed cutting element, so that the cutting does not always occur at the same time along the front side at the same middle distance, and the energy source charges at different times, rather almost continuous cutting takes place and the energy source is continuously charged at an equal rate. In this embodiment, the teeth 4 of the protective support extend only slightly beyond the teeth of the fixed cutting element 20' without pulling the teeth 4 of the protective support on the front side in front of the teeth of the cutting element, as is the case, for example, in known distance combs and protective combs. (One such protective comb is described, for example, in DE 103 55 154 A1. In that instance, the teeth of the protective comb extend on the front side significantly beyond the teeth of the shearing comb because in this case, the teeth of the protective comb ensure a thermal isolation of the heated shearing comb.) In this instance, the teeth 4 of the protective support 3 do not protrude into their area of extension over the teeth of the fixed cutting element 20' more than the sheet thickness of the fixed cutting element 20', wherein the slight extension has, in particular, a length of 0.2 mm or less and also, in particular, a length of 0.1 mm or less. In the exemplary embodiment shown, the sheet thickness of the fixed cutting element 20' is 0.35 mm and the teeth of the protective support extends approximately 0.1 mm beyond the teeth of the fixed cutting element 20'. In addition, the width b of a tooth 4 of the protective support 3 is approximately two and a half times as great as the width b' (FIG. 4 shows widths b and b') of the teeth of the fixed cutting element 20', and a tooth 4 of the protective support overlaps each space between two teeth of the fixed cutting element 20'. In the example shown, the width b is approximately 0.7 mm and the middle distance M' is approximately 0.55 mm, so that a tooth 4 of the protective support overlaps every two teeth of the fixed cutting element 20' and the space between them. The middle distance M (as shown, for example, in FIG. 4) of the teeth 4 of the protective support is three times as great as the middle distance M' of the teeth of the fixed cutting element 20', so that in each instance two spaces between the teeth of the fixed cutting element 20' remain uncovered between two teeth 4 of the protective support. In each instance, a tooth 4 of the protective support also has a protrusion 5 that extends into the space between two teeth of the fixed cutting element 20' that is covered by the tooth 4 of the protective support (at the same time, the protrusion has a height of approximately 0.2 mm and a length of 0.5 mm), wherein, in this instance, the protrusion extends on the front side slightly over the front of the teeth of the fixed element 20' (in the example shown, this is approximately 0.04 mm) and thus effectively prevents hair from getting caught in the remaining gap between the teeth 4 of the protective support and the teeth of the fixed cutting element 20'. Even if in this instance the protrusions 5 are shown as part of the embodiment according to FIG. 5 and FIG. 6, the protrusions 5 must be considered an optional feature that can also be omitted in the embodiment according to FIG. 5 and FIG. 6. The size of the teeth 4 of the protective support also prevents the teeth of the fixed cutting element 20' from getting caught in capillary ducts and, as a result, ripping them open. A typical value for the front-side width b of the teeth of the protective support is approximately 0.6 mm to 0.8 mm so as to avoid getting them caught in capillary ducts.

What is claimed is:

1. A hair trimmer having a front side, the trimmer having a fixed cutting element that has teeth on the front side, a mobile cutting element that oscillates in relation to the fixed cutting element that has teeth on the front side so that hair that gets caught between the teeth of the fixed and mobile cutting elements during use of the hair trimmer is cut off, and a protective support arranged on the fixed cutting element that is provided to allow placement of the hair trimmer on the skin of the user and which has teeth on the front side, wherein the teeth of the protective support close on the front side with the teeth of the fixed cutting element or extend in their area of extension only slightly over them and the teeth of the protective support lie, at least essentially, gap-free on the fixed cutting element, and further, wherein the middle distance (M') between the teeth of the fixed cutting element is from 0.1 to 0.9 mm, and further, wherein the middle distance (M) of the teeth of the protective support is greater than the middle distance (M') of the teeth of the fixed cutting element.

2. The hair trimmer according to claim 1, wherein the width (b) of the teeth of the protective support is greater than the width (b') of the teeth of the fixed cutting element.

3. The hair trimmer according to claim 1, wherein in each instance a tooth of the protective support overlaps at least one space between two teeth of the fixed cutting element.

4. The hair trimmer according to claim 3, wherein at least one tooth of the protective support has a protrusion that extends into the space overlapped by the tooth of the protective support.

5. The hair trimmer according to any of claim 1, wherein the teeth of the protective support are rounded off on the front side.

6. The hair trimmer according to any of claim 1, wherein the height of the teeth of the protective support that lie on the fixed cutting element is reduced on the front side.

7. The hair trimmer according to any of claim 1, wherein the teeth of the protective support do not extend in their area of extension further than the thickness of the teeth of the fixed cutting element in front of the teeth of the fixed cutting element.

8. The hair trimmer according to claim 7, wherein the teeth of the protective support extend in their area of extension by 0.2 mm or less and in particular by 0.1 mm or less in front of the teeth of the fixed cutting element.

9. The hair trimmer according to clam 1, wherein the width (b) of the teeth of the protective support is from 0.6 mm to 0.8 mm.

10. The hair trimmer according to claim 1, wherein the middle distance (M') between the teeth of the fixed cutting element is from 0.3 to 0.7 mm.

11. The hair trimmer according to claim 1, wherein the fixed cutting element is manufactured from a metal sheet having a material thickness of from 0.25 to 0.35 mm.

12. A hair trimmer having a front side, the trimmer having a fixed cutting element that has teeth on the front side, a mobile cutting element that oscillates in relation to the fixed cutting element that has teeth on the front side so that hair that gets caught between the teeth of the fixed and mobile cutting elements during use of the hair trimmer is cut off, and a protective support arranged on the fixed cutting element that is provided to allow placement of the hair trimmer on the skin of the user and which has teeth on the front side, wherein the teeth of the protective support close on the front side with the teeth of the fixed cutting element or extend in their area of extension only slightly over them and the teeth of the protective support lie, at least essentially, gap-free on the fixed cutting element, and further, wherein the middle distance (M') between the teeth of the fixed cutting element is from 0.1 to 0.9 mm, and further, wherein the protective support comprising the fixed cutting element is connected gap-free at least in the area of the teeth of the fixed cutting element.

13. The hair trimmer according to claim 12, wherein the width (b) of the teeth of the protective support is greater than the width (b') of the teeth of the fixed cutting element.

14. The hair trimmer according to claim 12, wherein in each instance a tooth of the protective support overlaps at least one space between two teeth of the fixed cutting element.

15. The hair trimmer according to claim 14, wherein at least one tooth of the protective support has a protrusion that extends into the space overlapped by the tooth of the protective support.

16. A hair trimmer having a front side, the trimmer having a fixed cutting element that has teeth on the front side, a mobile cutting element that oscillates in relation to the fixed cutting element that has teeth on the front side so that hair that gets caught between the teeth of the fixed and mobile cutting elements during use of the hair trimmer is cut off, and a protective support arranged on the fixed cutting element that is provided to allow placement of the hair trimmer on the skin of the user and which has teeth on the front side, wherein the teeth of the protective support close on the front side with the teeth of the fixed cutting element or extend in their area of extension only slightly over them and the teeth of the protective support lie, at least essentially, gap-free on the fixed cutting element, and further, wherein the middle distance (M') between the teeth of the fixed cutting element is from 0.1 to 0.9 mm, and further, wherein the fixed cutting element is manufactured from a metal sheet having a material thickness of from 0.1 to 0.5 mm.

17. The hair trimmer according to claim 16, wherein the teeth of the protective support do not extend in their area of extension further than the thickness of the teeth of the fixed cutting element in front of the teeth of the fixed cutting element.

18. The hair trimmer according to claim 17, wherein the teeth of the protective support extend in their area of extension by 0.2 mm or less and in particular by 0.1 mm or less in front of the teeth of the fixed cutting element.

19. The hair trimmer according to claim 16, wherein the width (b) of the teeth of the protective support is from 0.6 mm to 0.8 mm.

* * * * *